US009862585B2

(12) United States Patent
Ramnarain et al.

(10) Patent No.: US 9,862,585 B2
(45) Date of Patent: Jan. 9, 2018

(54) CONTINUOUS MOTION LINEAR CONTAINER FILLER

(71) Applicant: PSR Automation Inc., Shakopee, MN (US)

(72) Inventors: David R. Ramnarain, Shakopee, MN (US); Brian D. Ramnarain, Shakopee, MN (US); Christopher D. Ramnarain, Shakopee, MN (US)

(73) Assignee: PSR AUTOMATION, INC., Shakopee, MN (US)

( * ) Notice: Subject to any disclaimer, the term of this patent is extended or adjusted under 35 U.S.C. 154(b) by 89 days.

(21) Appl. No.: 15/167,118

(22) Filed: May 27, 2016

(65) Prior Publication Data

US 2017/0341919 A1 Nov. 30, 2017

(51) Int. Cl.

| | |
|---|---|
| ***B67C 3/22*** | (2006.01) |
| ***B67C 3/26*** | (2006.01) |
| ***B65B 3/12*** | (2006.01) |
| ***B65B 57/00*** | (2006.01) |
| ***B65B 43/52*** | (2006.01) |

(52) U.S. Cl.

CPC ..... *B67C 3/225* (2013.01); *B65B 3/12* (2013.01); *B65B 43/52* (2013.01); *B65B 57/00* (2013.01); *B67C 3/26* (2013.01)

(58) Field of Classification Search

CPC ..... B67C 3/225; B67C 3/2625; B65B 43/42; B65B 43/52; B65B 43/56

USPC ..... 141/135, 234–237, 270, 284; 198/459.3, 198/657

See application file for complete search history.

(56) References Cited

U.S. PATENT DOCUMENTS

| | | | | |
|---|---|---|---|---|
| 156,518 | A | 11/1874 | Wight | |
| 1,460,211 | A | 6/1923 | Nicholas et al. | |
| 2,500,465 | A | 3/1950 | Meyer | |
| 4,004,620 | A * | 1/1977 | Rosen | B65B 57/02 141/137 |
| 4,201,251 | A * | 5/1980 | Bennett | B65B 57/06 141/155 |
| 5,305,809 | A * | 4/1994 | Pringle | B67C 3/26 141/157 |
| 5,971,041 | A * | 10/1999 | Drewitz | B65B 39/14 141/135 |
| 6,276,409 | B1 * | 8/2001 | Ellison | B65B 21/04 141/178 |
| 6,372,185 | B1 * | 4/2002 | Shumate | B01J 19/00 422/510 |
| 6,412,523 | B2 * | 7/2002 | Brozell | B05B 11/3009 141/2 |
| 6,896,849 | B2 * | 5/2005 | Reed | B01D 61/18 141/130 |
| 6,983,577 | B2 * | 1/2006 | Hartness | B65B 21/183 141/145 |
| 7,108,024 | B2 * | 9/2006 | Navarro | B65B 3/12 134/169 C |
| 7,284,577 | B2 * | 10/2007 | Yoneda | B65G 33/04 141/129 |

(Continued)

*Primary Examiner* — Timothy L Maust

(74) *Attorney, Agent, or Firm* — Nickolai & Mersereau, P.A.; Thomas J. Nikolai

(57) ABSTRACT

A conveyor and carriage assembly are synchronized to increase the speed of operation and eliminate any dwell periods to improve the rate at which a linear container filler is able to fill containers with a material. The fill rate approaches or exceeds that of prior art linear and rotary filling machines.

20 Claims, 13 Drawing Sheets

(56) References Cited

U.S. PATENT DOCUMENTS

| | | | | |
|---|---|---|---|---|
| 7,322,170 | B2 * | 1/2008 | Tomalesky | B65B 7/2835 141/129 |
| 7,549,275 | B2 * | 6/2009 | Monti | B65B 7/28 177/53 |
| 7,685,796 | B2 * | 3/2010 | Capelli | B67B 1/04 53/266.1 |
| 9,493,254 | B2 * | 11/2016 | Boira Bonhora | G01G 17/00 |
| 2017/0073205 | A1 * | 3/2017 | Vesentini | B67B 3/20 |

* cited by examiner

CONTINUOUS MOTION LINEAR CONTAINER FILLER

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates to equipment used to fill containers with liquids, other fluids or other fluidized materials such as powders and granulated solids, hereinafter all collectively referred to as fluids or material. More specifically, the present invention relates to continuous motion linear container filling machines.

II. Related Art

Since the 1870's, there has been an on-going effort to invent even faster and more efficient bottle filling machines. In 1874, for example, Charles H. Wight was awarded U.S. Patent No. 156,518 on a bottle filling machine that filled bottles "with greater rapidity than the usual process, without waste of material or breakage of bottles". Numerous patents directed to bottle filling machines were awarded between 1900 and 1910. In 1923, R. L. Nicholas et al was awarded U.S. Pat. No. 1,460,211 for a bottle filling machine having a rotatable table. Empty bottles are fed onto the table, rotated to a filling position where they are filled and then discharged from the table and capped. In 1950, U.S. Pat. No. 2,500,465 was granted to G. J. Meyer on another filling machine drive with a rotary bottle filling station.

More recently, a variety of linear bottle filling machines have been developed. None, however, have heretofore been able to fill bottles as fast as rotary filling machines. With respect to many of these machines, this is because these machines stop the bottles at the filling station and then restart movement of the bottles after a subset of the bottles have been filled. Machines that use conveyors that do not stop the bottles at the filling station tend to move the bottles at relatively slow speeds. This is necessary to align empty bottles with the fill nozzles of the liquid dispensing apparatus during filling. Also, the dispensing apparatus and nozzles have significant dwell periods in which they sit idle until the slow moving conveyor moves empty bottles into position. Thus, the space saving advantages of linear filling equipment have been offset by the slow container filling routine as compared to rotary filling equipment.

SUMMARY OF THE INVENTION

In view of the foregoing, there is a real need for filling equipment that offers the space saving advantages of a linear machine yet achieves substantially the same (or faster) bottle filling rates as rotary filling machines. The present invention achieves these goals by providing a linear filling machine having nozzles that are in constant motion without any dwell period during operation. Even greater fill rates may be achieved by providing a linear filling machine capable of filling a plurality of rows of containers at a filling station simultaneously.

In one embodiment, an apparatus for filling containers with a material is provided. The containers each have a top opening with a center point. The apparatus comprises a base, a conveyor, a carriage assembly and a microcontroller. The conveyor is coupled to the base. The conveyor is adapted to carry the plurality of containers in at least one row of containers in a first direction. The containers are carried by the conveyor at a predetermined constant speed with the center points of the top openings of the adjacent containers in each row of containers being a predetermined distance apart.

The carriage assembly is coupled to the base and disposed above the conveyor. The carriage assembly has a vertical carriage, a horizontal carriage, and a plurality of nozzles. Each nozzle has an ejection port. The horizontal carriage is adapted to reciprocate side to side between a first termination point and a second termination point. The vertical carriage is coupled to the horizontal carriage and adapted to be moved up and down relative to the conveyor between a raised position and a lowered position. The nozzles are arranged in the same number of rows as the number of rows of containers carried by the conveyor. The nozzles are adapted to move up and down with the vertical carriage and side to side with the horizontal carriage. Each row of nozzles has a leading nozzle. The ejection ports of each adjacent pair of nozzles in each row of nozzles is the same predetermined distance apart as the center points of the top openings of the containers in a row of containers carried by the conveyor.

Servomotors drive the conveyor and turn screw gears to move the vertical carriage up and down between the raised and lowered positions and the horizontal carriage side-to-side between the first and second termination points. A controller is adapted to control the servomotors and, thus, synchronize movement of the conveyor and the vertical and horizontal carriages. Specifically, the controller controls a first servomotor to regulate the up and down movement of the vertical carriage. The controller also controls a second servomotor to regulate the reciprocating side-to-side movement of the horizontal carriage between the two termination points. At least one other servomotor controls the conveyor's speed and position.

When the apparatus described above is in use, the conveyor carries a plurality of containers in the first direction. The controller also repeatedly cycles the carriage assembly to:

- cause the horizontal carriage, upon reaching the first termination point, to immediately move toward the second termination point with each of the nozzles aligned with the top openings of containers to be filled,
- cause the vertical carriage, while the horizontal carriage is moving from the first termination point to the second termination point, to move from the raised position to the lowered position so that each of the nozzles engages a container to be filled with the material and, after the containers engaged by the nozzles are filled with the material, to return to the raised position no later than the point in time at which horizontal carriage reaches the second termination point,
- cause the horizontal carriage to move toward the first termination point immediately upon the horizontal carriage reaching the second termination point, and
- cause the leading nozzle of each row of nozzles to be positioned above the first yet to be filled container in each row of containers upon the horizontal carriage assembly reaching the first termination point and beginning to again move back toward the second termination point.

The above-described movements of the conveyor and the vertical and horizontal carriages are repeated until a desired number of the containers are filled with the material.

As should be clear from the foregoing, movement of the first and second carriages of the carriage assembly is coordinated with the speed at which containers are carried by the conveyor. Also, since the conveyor is constantly moving, and there is no dwell in the operation of the carriage assembly, the rate at which the containers are filled may be maximized.

By increasing the number of nozzles in a row and the number of rows of nozzles (and rows of containers), the speed of the linear filing machine of the present invention certainly equals and, in fact, can easily exceed the filling rate achieved using prior art rotary and linear filing equipment.

Various other features may be provided. For example, the conveyor may comprise one or more screws, each turned by a servomotor controlled by the controller to control the rate at which the screws turn and, thus, the rate at which the containers move through the filling apparatus. Also, screws with differently shaped flights may be used to accommodate containers of different sizes and shapes. The type of nozzles used may be varied. Also, flow through the nozzles may be controlled either via valves opened and closed by the controller, pumps turned on and off by the controller, or a combination thereof. Alternatively, the valves may be mechanically and automatically actuated so the valves are open when the nozzles are in engagement with the container opening and close when the nozzles disengage from the containers. When a pump alone is employed to control flow through the nozzles, a mechanically and automatically actuated switch may be employed that closes a circuit energizing the pump when the nozzles are in engagement with the container openings and opens the circuit to shut off the pump and flow when the nozzles disengage from the container openings. The number of lines of nozzles and the number of nozzles in a line may be varied. Also, a mechanism other than screws turned by servomotors may be employed to move the carriages of the carriage assemblies.

BRIEF DESCRIPTION OF THE DRAWINGS

The foregoing features, objects and advantages of the invention will become apparent to those skilled in the art from the following detailed description and with reference to the following drawings in which like numerals in the several views refer to corresponding parts.

DETAILED DESCRIPTION

Figure 1:
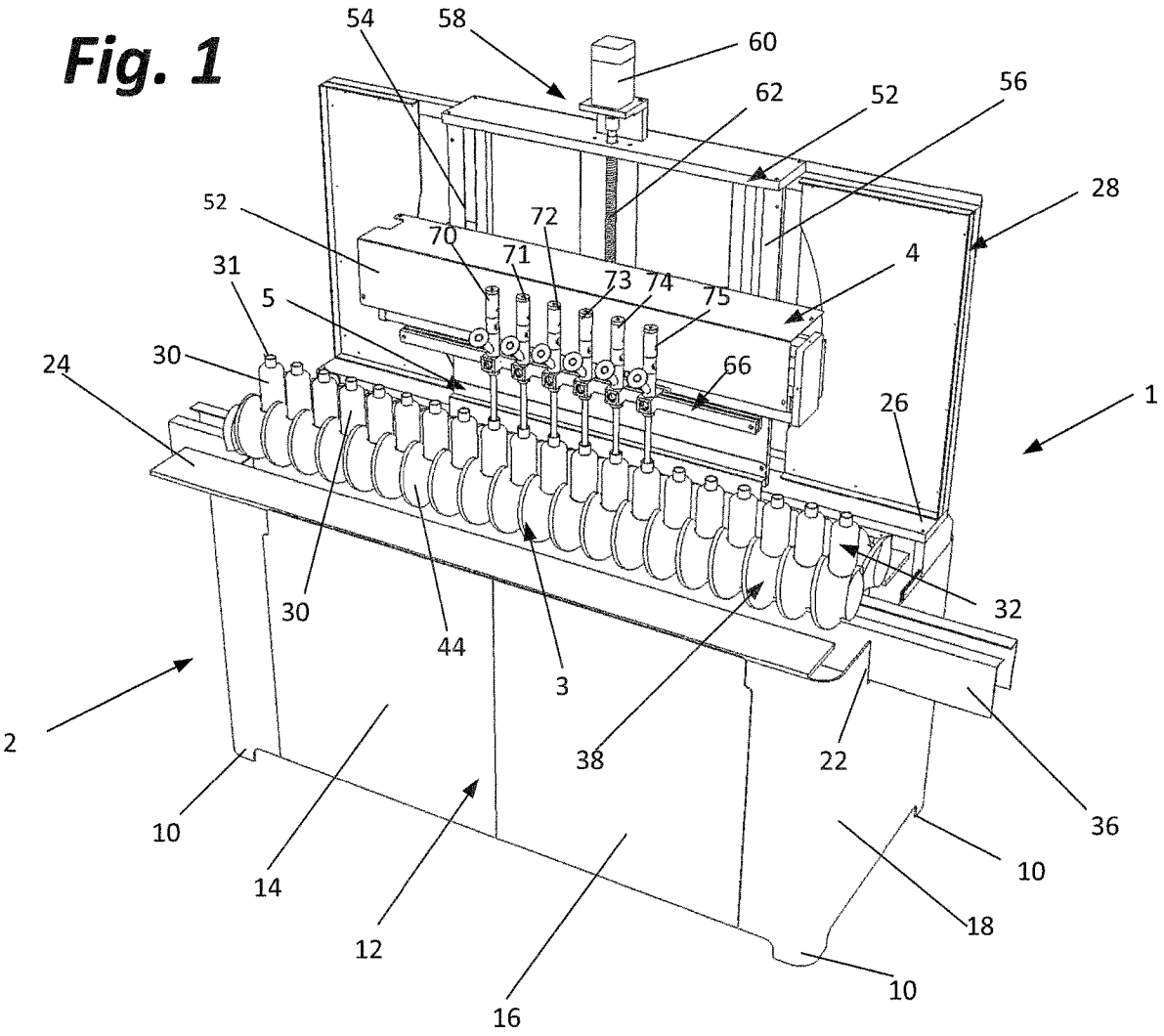
FIG. 1 is a perspective view of a continuous motion linear container filled.

In the following detailed description, reference is made to various exemplary embodiments in which the invention may be practiced. These embodiments are described with sufficient detail to enable those skilled in the art to practice the invention, and it is understood that other embodiments may be employed, and that structural and other changes may be made without departing from the spirit or scope of the present invention.

This description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top" and "bottom", "under", as well as derivatives thereof (e.g., "horizontally", "downwardly", "upwardly", "underside", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "joined", and "joining" are used interchangeably and refer to one structure or surface being secured to another structure or surface or integrally fabricated in one piece unless expressly described otherwise.

As shown in the drawings, the continuous motion container filler 1 comprises a base 2, a conveyor assembly comprising a conveyor 3 and a carriage assembly 4. The base 2 supports the conveyor 3 and carriage assembly 4.

The base 2 comprises feet 10 which support the base 2 above the floor of a plant. The base 2 also includes a housing comprising a front wall 12 having a pair of doors 14 and 16. The base 2 also includes side walls 18 and a rear wall 20. Each side wall includes a downwardly extending conveyor support receiver slot 22. Extending inwardly from the front wall 12 and inwardly from the rear wall is a pair of horizontal top panels 24 and 26. The distance between the top panels 24 and 26 is greater than or equal to the width of the conveyor support receiver slots 22. Extending upwardly from the top panel 26 is carriage assembly support 28.

Figure 2:
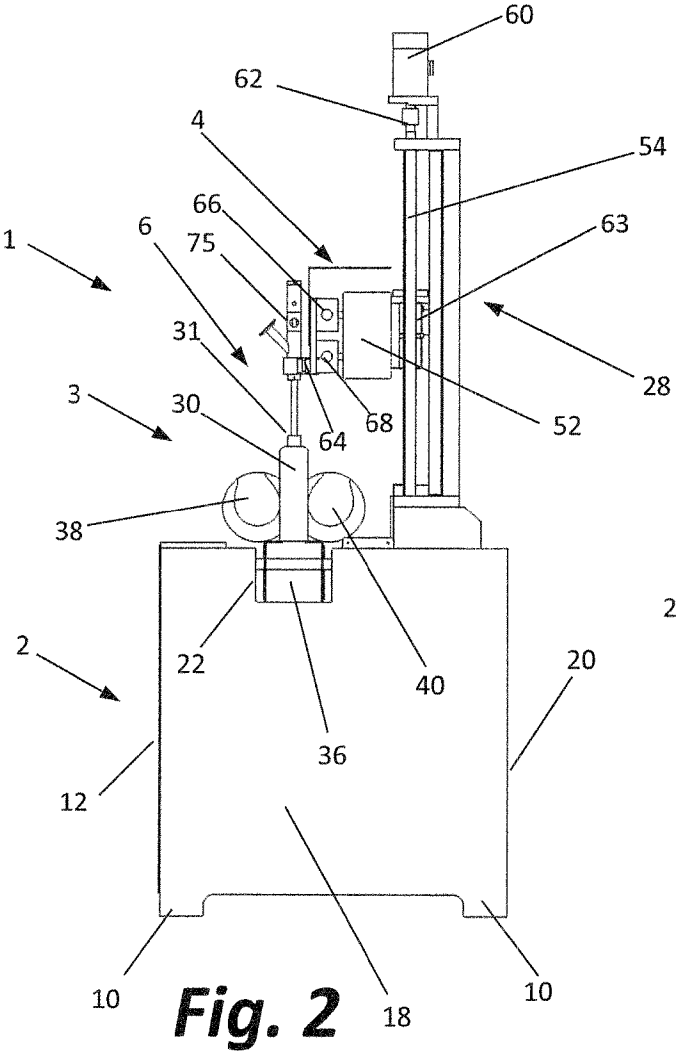
FIG. 2 is a side view of the continuous motion linear container filler of FIG. 1.

Two embodiments of conveyor 3 are shown in the drawings. A conveyor 3 designed to convey the containers 30 (each having a top opening 31) in a single row 32 is shown in FIGS. 1 and 2. A conveyor 3 designed to convey the containers 30 in two parallel rows 32 and 34 are shown in FIGS. 3-12. In either case, conveyor 3 includes a conveyor support 36 mounted across the frame 2 and extending through and beyond the conveyor support receiver slots 22. The conveyor 3, shown in FIGS. 1 and 2, includes a pair of screws 38 and 40 extending the length of the conveyor 3.

Figure 4:
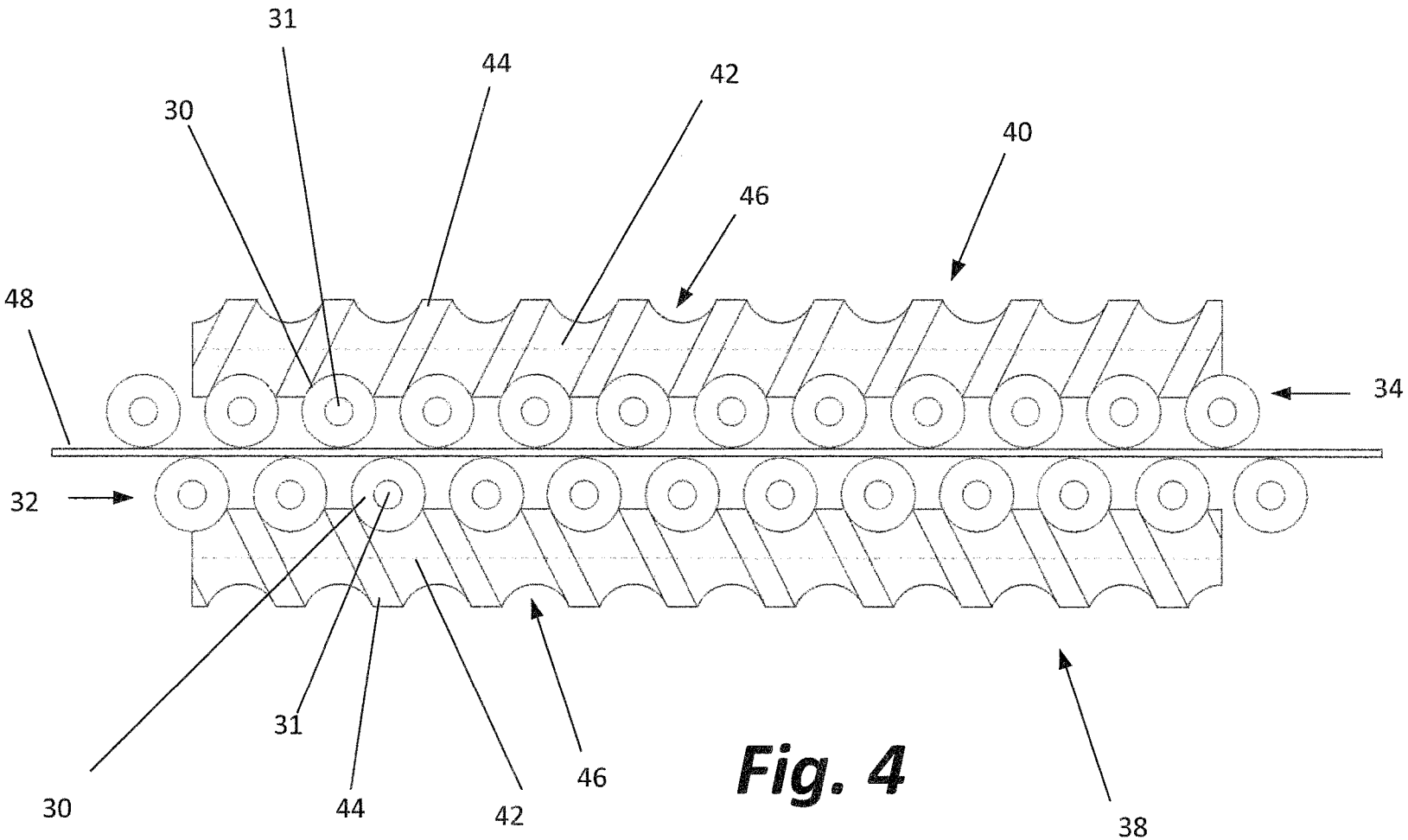
FIG. 4 is a partial top view of the conveyor of the continuous motion linear container filler of FIG. 3.
Figure 5:
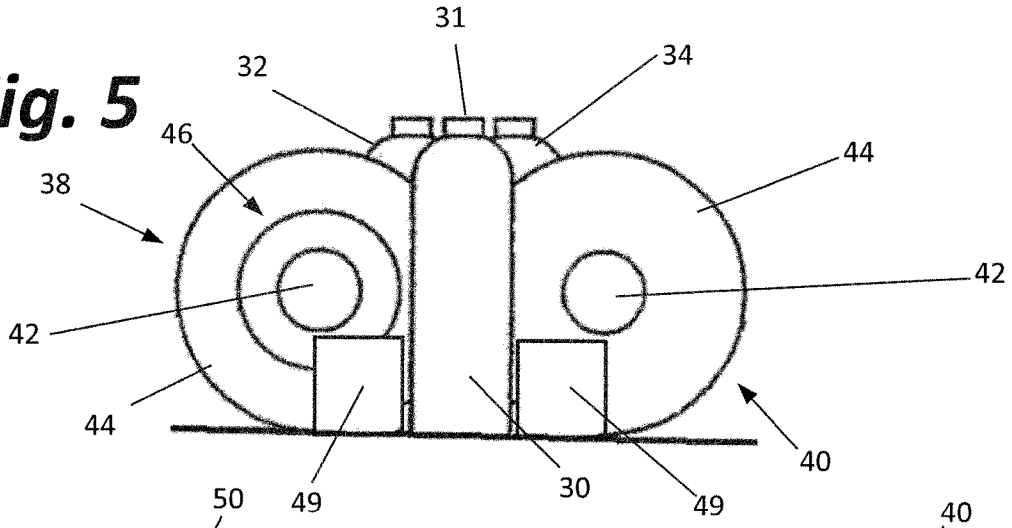
FIG. 5 is an end view of the conveyor of FIG. 4.
Figure 6:
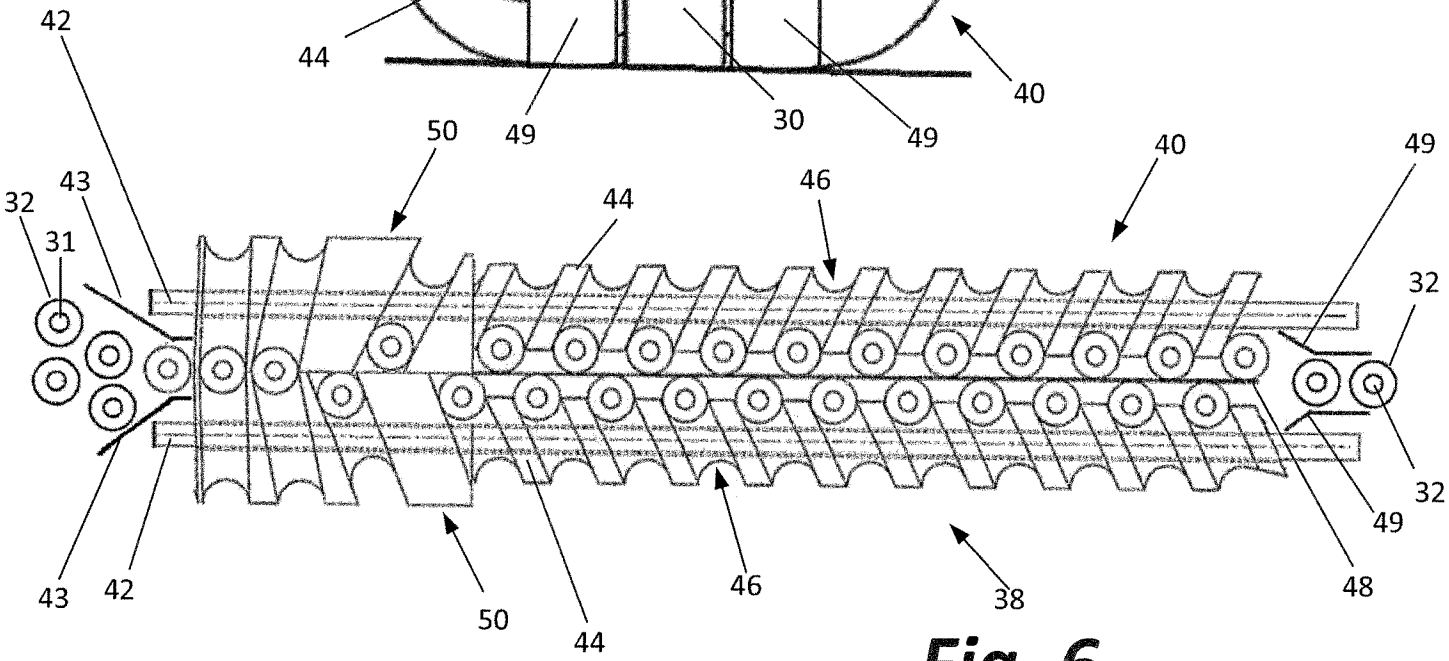
FIG. 6 is a top view of the conveyor shown in FIG. 5.

As shown in FIGS. 4-6, each screw 38 and 40 includes a shaft 42 and a flight 44 extending in a spiral fashion along the length of the shaft 42. The shaft 42 defines a longitudinal axis. The spaces 46 between adjacent turns of the flight 44 are adapted so that containers 30 of a particular size reside in the spaces 46 between each pair of turns of flight 44. Turning of the screws 38 and 40 along the longitudinal axis of shaft 42 in unison (using a single motor and gears or a pair of motors) causes containers 30 to be moved by the flights 44 of the screws 38 and 40 the length of the conveyor 3.

In the embodiment shown in FIGS. 3-12, the containers 30 are carried by the flights 44 of screws 38 and 40 in two rows 32 and 34. This is achieved by installing a guide plate 48 between the two screws that extend parallel to the longitudinal axis of the shafts 42 of screws 38 and 40. These shafts 38 and 40 are also parallel to each other.

Of course, some device must be used to divide the container 30 into first row 32 and second row 34. Various such devices are well known in the conveyor art. One such device is shown in FIG. 6.

Figure 3:
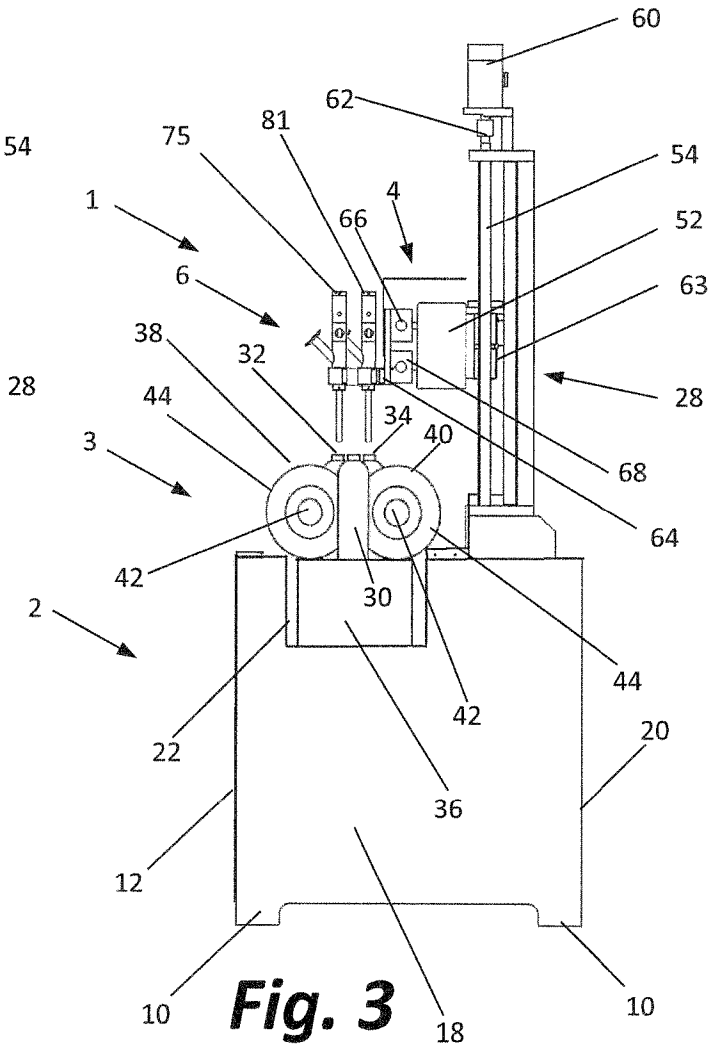
FIG. 3 is a side view of a second embodiment of a continuous motion linear container filler.

Specifically, FIG. 6 shows at the left hand side a first funnel mechanism comprising funnel plates 43 that funnels the containers 30 into a single row. The flights 44 of the two screws cooperate on the left hand side of FIG. 6 to carry the single row of containers 30 to offset dividing members 50 in the contours of the flights 44. These offset dividing members position, in an alternating fashion, the containers 30 on opposite sides of the guide plate 48. As illustrated, the containers 30 that form the first row 32 are offset from the containers 30 that form the second row 34. At the same time, the guide plate 48 and the screws 38 and 40 maintain the two rows 32 and 34 parallel to each other. The two screws 38 and 40, in design and construction, resemble mirror images of each other (but this is not necessarily the case depending on the shape of the containers for example) with one screw having right hand threads and the other having left hand threads. They are installed and operate so that the two screws 38 and 40 rotate in a coordinated fashion so that these screws not only push the containers forward, but also apply a downward rubbing force against the containers as the screws rotate which serves to stabilize the containers on the conveyor. When viewed as illustrated in FIGS. 2 and 3, screw 38 rotates clockwise and screw 40 rotates counterclockwise. If the rotation of the screws 38 and 40 were to rotate upwardly with respect to the containers rather than downwardly, the upward rubbing force would lift the containers making them unstable.

Further, the center points of the top openings 31 of any two adjacent containers in row 32 are the same distance apart. As shown, they also form a substantially equilateral triangle with the center point of a top opening 31 of a container 30 in row 34, but this is not necessarily the case. What is Important is that the spacing between the top openings of containers of a row and the spacing between the top openings of containers two rows be adapted based on the spacing of the nozzles. The containers are carried in this configuration through the filling station 6 of the filler 1. After the containers 30 are filled and exit the filling station 6, the two rows 32 and 34 are merged back into a single row as the containers 30 exit the conveyor 3 by a second funnel mechanism comprising funnel plates 49.

Figure 13:
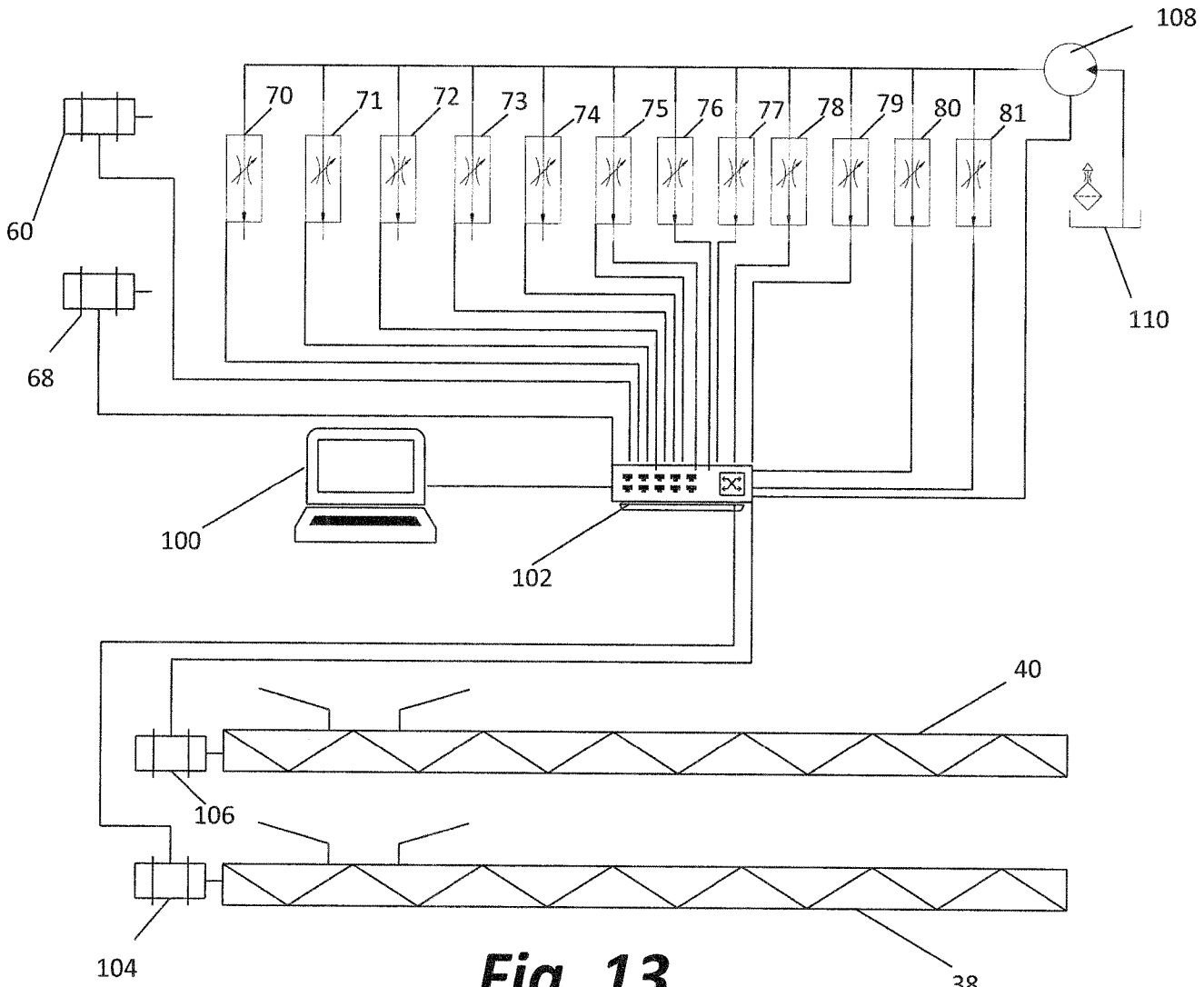
FIG. 13 is a schematic diagram showing a controller coupled to the devices of the filler that may be controlled by the controller.

As illustrated in FIG. 13, screw 38 is rotated by a motor 104 and screw 40 is rotated by a motor 106. A single motor may be used in which case a gear train or drive belt is used to rotatably couple the motor to the shafts 42. Such motor(s) may be servomotors, which send signals to and receive signals from a controller 100, as shown schematically in FIG. 13.

As shown in FIGS. 1-3 and 7-12, the carriage assembly 4 is mounted to the carriage assembly support 28 of the base 2. The carriage assembly 4 includes a vertical carriage 52 adapted to reciprocate between a raised position shown in FIG. 7 and a lowered position shown in FIG. 8. Such motion is achieved by mounting the vertical carriage for reciprocation movement along vertically extending parallel rails 54 and 56 that are fixed to the carriage assembly support 28. The up and down motion of the vertical carriage 52 along rails 54 and 56 is imparted by a screw jack 58 comprising servomotor 60 that rotates an elongate threaded screw 62 that is coupled to a threaded member 63 fixed to the vertical carriage 52.

Secured to the front of the vertical carriage is a horizontal track 64. Coupled to the track 64 in a manner that permits it to reciprocate horizontally along the track 64 is a horizontal carriage 66. The horizontal carriage 66 is able to reciprocate along the track 64 between a first termination point illustrated in FIG. 7 and a second termination point illustrated in FIG. 11. The reciprocating motion is supplied by a servomotor 68 operatively coupled to the horizontal carriage 66 in any of a variety of ways, e.g., by a sprocket and chain arrangement, by a pulley and belt arrangement, or by a screw jack arrangement of the same type used to move vertical carriage 52.

Mounted to the horizontal carriage 66 is a plurality of nozzles. Six nozzles 70-75 are aligned in a single row in FIG. 1. In FIGS. 7-12, two rows of six nozzles are shown. The first row comprises nozzles 70-75. The second row comprises nozzles 76-81. Each nozzle 70-81 has an ejection port at the bottom through which fluid from the nozzles flows into the containers. As such, the spacing of the nozzles 70-75 and of nozzles 76-81 is such that the ejection ports of each nozzle employed is immediately above or has passed through the top opening 31 of a container 30 as material is dispensed from the nozzles.

In the case of the embodiment of FIG. 1, each of the nozzles 70-75 is spaced in a single line. The spacing between each adjacent pair of nozzles, and more particularly the spacing between the ejection ports of adjacent pairs of nozzles, is the same as the spacing between the center points of the top openings 31 of adjacent pairs of containers 30 carried by conveyor 3 so that all six of nozzles 70-75 may be centered simultaneously over the openings 31 of six containers 30 in the row 32 of containers.

Figure 7:
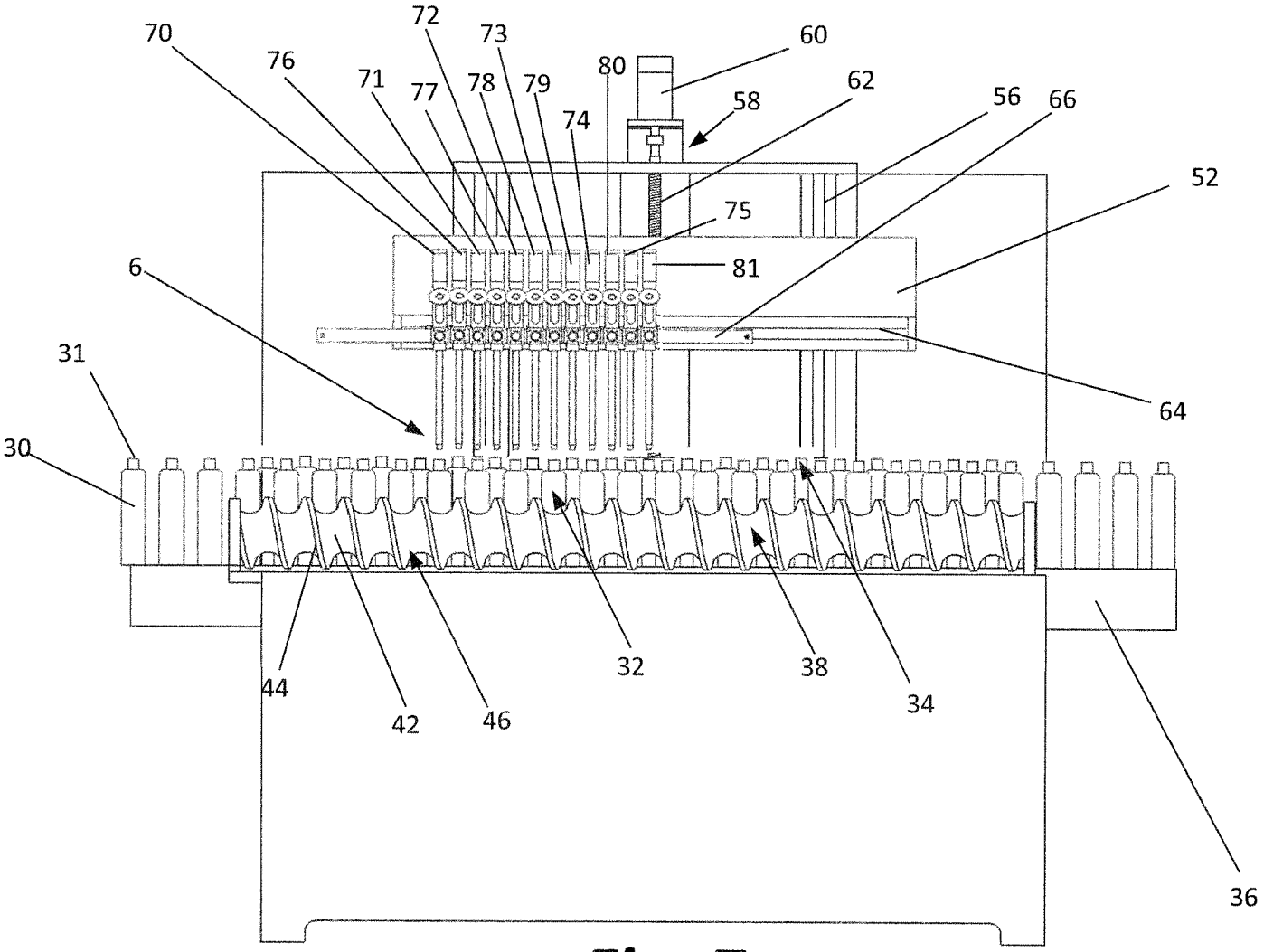
FIG. 7 is a front view of the continuous motion linear container filler of FIG. 3 showing a carriage assembly having a vertical carriage in its raised position and a horizontal carriage at a first termination point.
Figure 8:
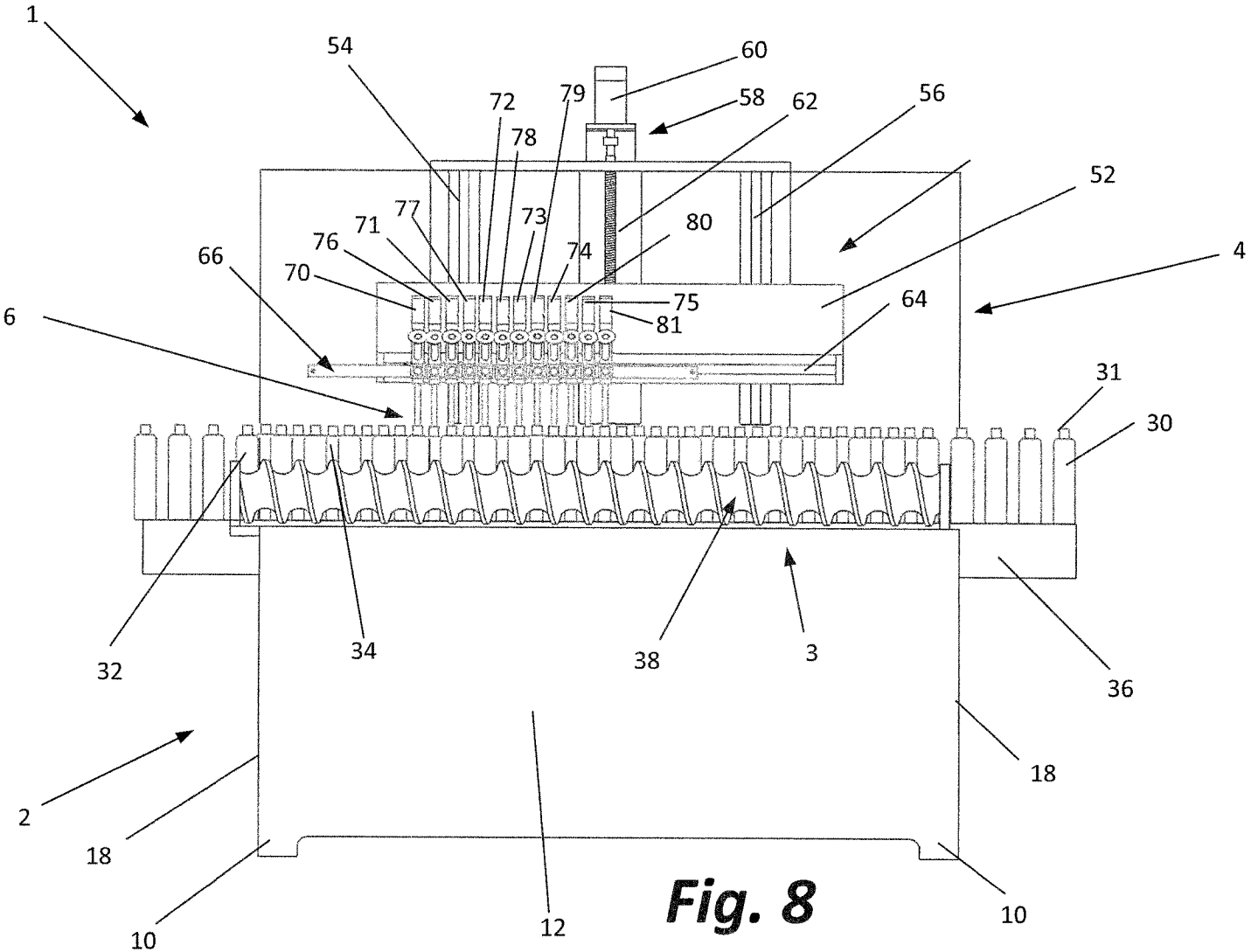
FIG. 8 is a front view showing the carriage assembly of FIG. 7 with the vertical carriage assembly in its lowered position and the horizontal carriage just to the right of the first termination point.
Figure 9:
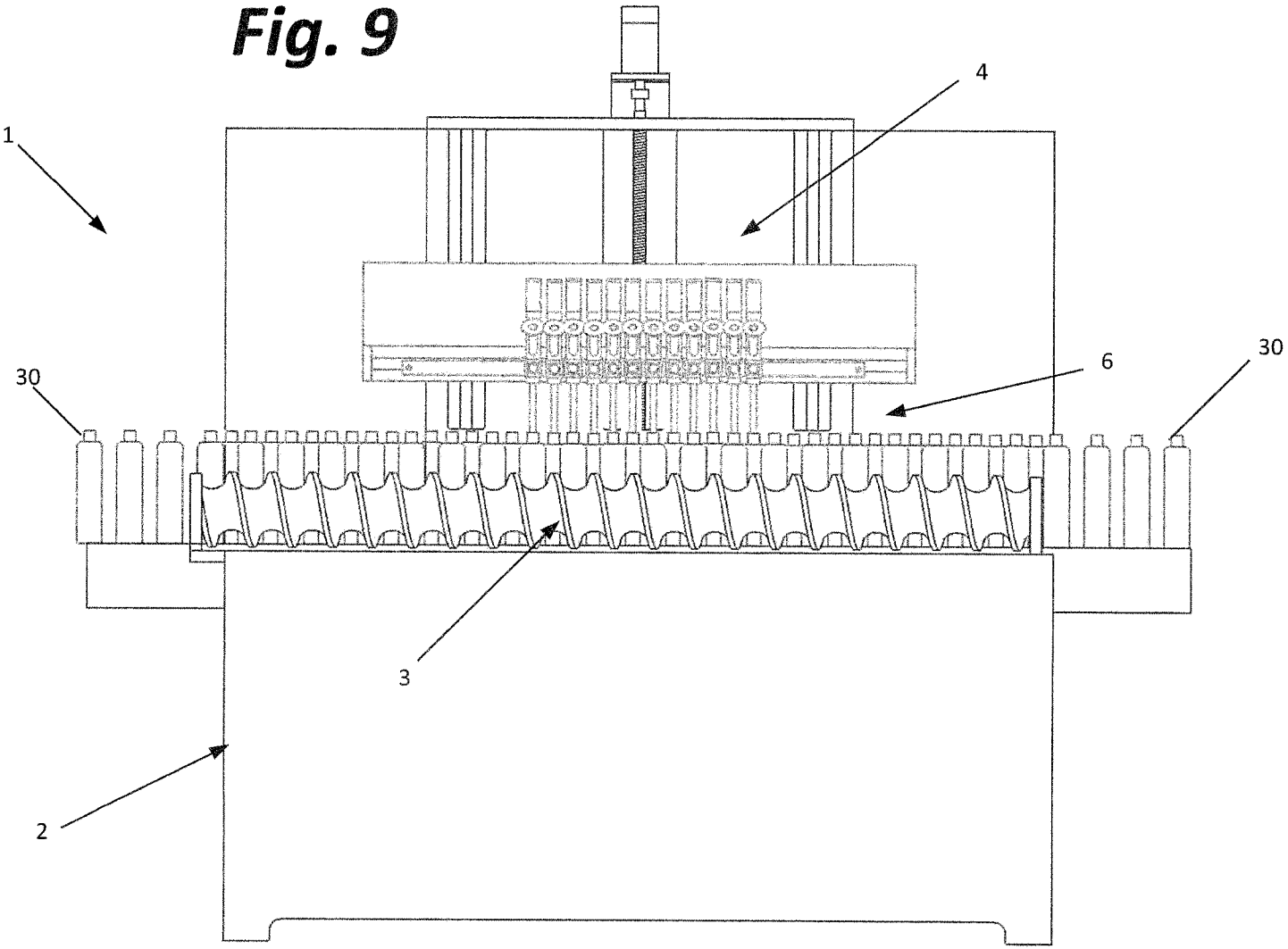
FIG. 9 is a front view of the carriage assembly of FIG. 7 with the vertical carriage assembly in its lowered position and the horizontal carriage about midway between the first termination point and second termination point.

In the case of the embodiment of FIG. 7, each of nozzles 70-75 are spaced in a first row as described above. Nozzles 76-81 are spaced in a second row. The spacing between each adjacent nozzle, and more particularly, the spacing between the ejection ports of the adjacent pairs of nozzles 76-81 is the same as the spacing between the center points of the top openings of adjacent containers 30 of the second row 34 of containers carried by the conveyor 3. Further, the spacing between the first row of nozzles 70-75 and the second row of nozzles 76-81 is the same as the distance between the first row 32 and the second row 34 of containers. As such, each nozzle 70-81 is able to be simultaneously positioned so that the ejection port of each nozzle is over the top opening 31 of separate containers 30 to be filled.

In view of the foregoing, it should be clear that the spacing between the nozzles (70-75 in the case of the embodiment of FIG. 1, and 70-81 in the case of the embodiment of FIG. 7) must be such that all nozzles can be simultaneously positioned over the top openings 31 of containers 30 to be filled. Likewise, to actually fill the containers 30 with material using the nozzles, the nozzles must move in synchronicity with the containers. This is achieved by providing a controller 100 that coordinates movement (and operation) of the nozzles with movement of the containers.

As shown in FIG. 13, the controller 100 is a computer coupled to a switch or router 102. The switch 102 couples the controller 100 to five motors. Motor 104 turns the screw 38 and motor 106 turns the screw 40 of conveyor 3. As described above, motor 60 turns the screw 62 of the screw jack 58 to move the vertical carriage 52 up and down and motor 68 moves the horizontal carriage 66 side to side. The fifth motor is part of the pump/motor assembly 108 that pumps material from a vented reservoir 110 to the valves in each of nozzles 70-81. The opening and closing of these valves is also under the control of controller 100. Ideally, each of the motors is a servomotor that provides feedback related to its state, position and speed to the controller 100. The controller processes this data to generate control signals to the valves and motors to regulate the operation of the filler 1.

More specifically, the controller 100 sends control signals to the motors 104 and 106 to control position of screws 38 and 40 and the speed at which the screws 38 and 40 turn. Thus, the position and speed of the containers 30 carried by the conveyor is regulated by the controller 100. The controller 100 also sends signals to the motor 60 to control the position, timing and speed of the vertical carriage 52 as it is moved up and down. The controller 100, likewise, sends control signals to motor 68 to control the position, timing and speed of the horizontal carriage 66 as it moves side to side. The controller 100 may also send control signals to the pump/motor assembly 108 and/or the valves associated with each of the nozzles 70-81 to regulate the flow of material through the nozzles and into the containers to ensure that material is only placed in the container and not spilled or wasted.

With reference to FIGS. 7-12, the movement of the carriages 52 and 66 of carriage assembly 4 will now be explained. First, with the valves of the nozzles closed, the horizontal carriage 66 and the vertical carriage 52 are in the "start" position, shown in FIG. 1. The controller 100 then turns on the motors 104 and 106 causing the two screws 38 and 40 to turn. The controller 100 monitors and controls the speed of motors 104 and 106 to synchronize the turning of the screws 38 and 40. Once the screws 38 and 40 on conveyor 3 are so synchronized, the controller sends signals to motor 68 causing the motor 68 to move the horizontal carriage 66 to the left so that the ejection port of each of nozzles 70-81 is and remains properly aligned.

Once the desired predetermined speed and synchronicity of the screws 38 and 40 is achieved and proper alignment and synchronization of the horizontal carriage 66 with the conveyor 3 is also achieved, containers 30 are supplied to the conveyor 3. Control signals are also sent to servomotor 60 causing it to lower the vertical carriage 52 so the nozzles 70-75 and 76-81 engage (e.g., mate with) the top openings of the containers 30. When the nozzles are in the position shown in FIG. 8, the controller 100 sends a control signal to the motor of pump/motor assembly 108 and/or the valves of the nozzles 70-81 causing a predetermined quantity of material to be pumped into each container in communication with a nozzle as the containers and horizontal carriage 66 move together from the first termination point shown in FIG. 7 through the positions shown in FIGS. 8 and 9 and to the second termination point shown in FIG. 10.

Figure 10:
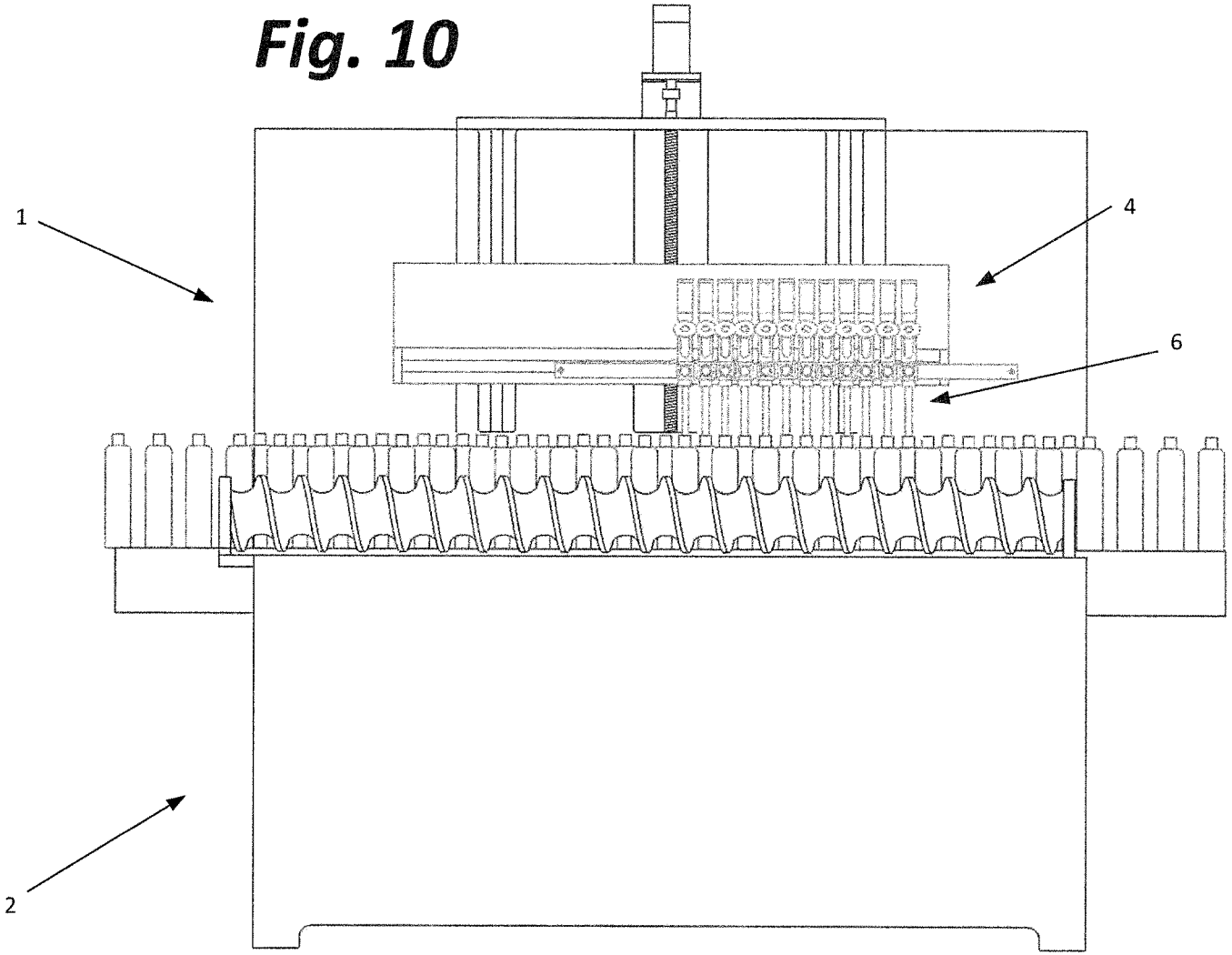
FIG. 10 is a front view of the carriage assembly of FIG. 7 with the vertical carriage in its lowered position and the horizontal carriage at the second termination point.
Figure 11:
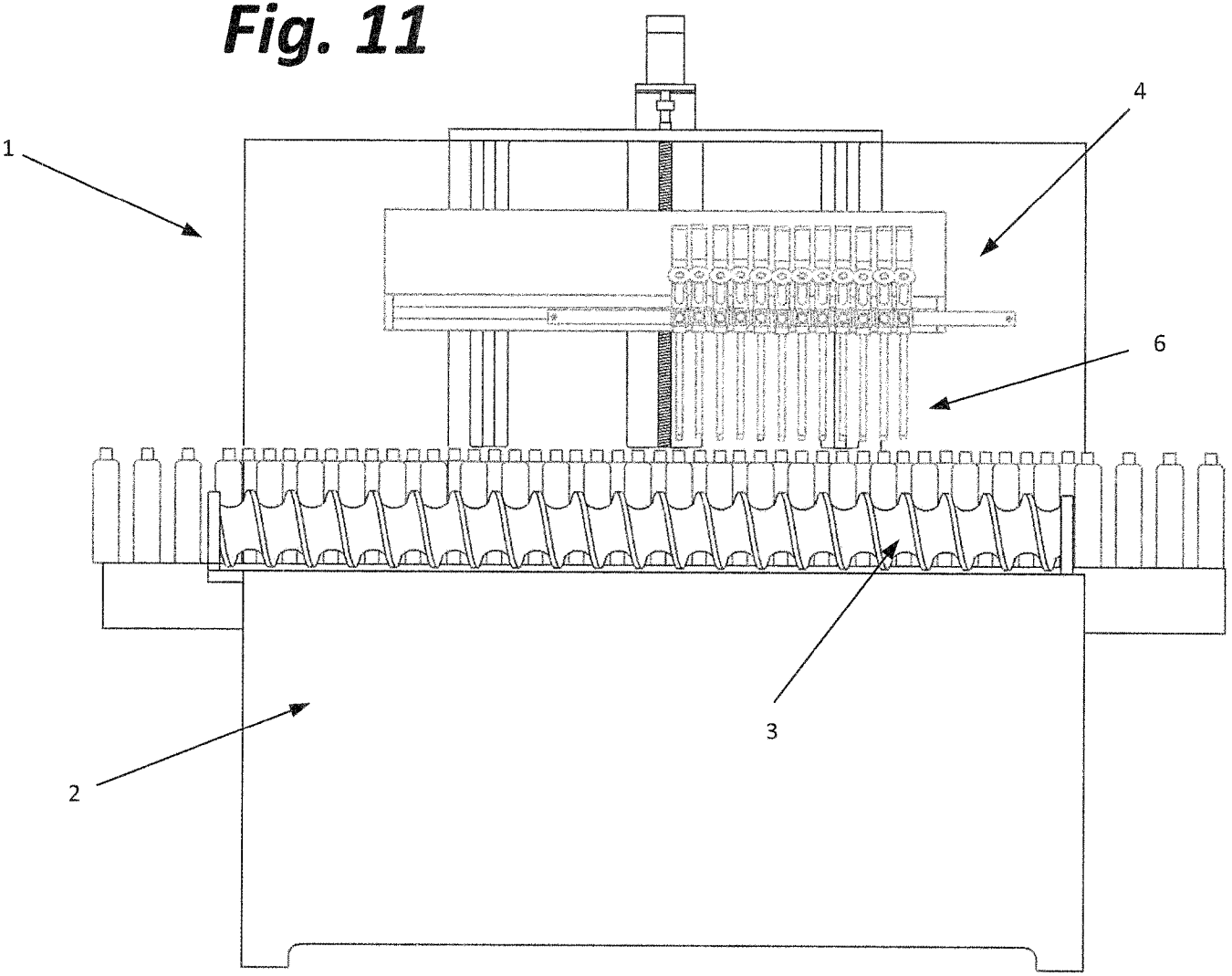
FIG. 11 is a front view of the carriage assembly of FIG. 7 with the vertical carriage in the raised position and the horizontal carriage at the second termination point.

Prior to the horizontal carriage 66 reaching the second termination point shown in FIG. 10, the controller closes the nozzle valves and/or_ turns off the pump/motor assembly 108 to turn off the flow of materials through the nozzles. The controller also sends a control signal to motor 60 causing it to lift the vertical carriage 52 from the position shown in FIG. 10 to the position shown in FIG. 11.

Figure 12:
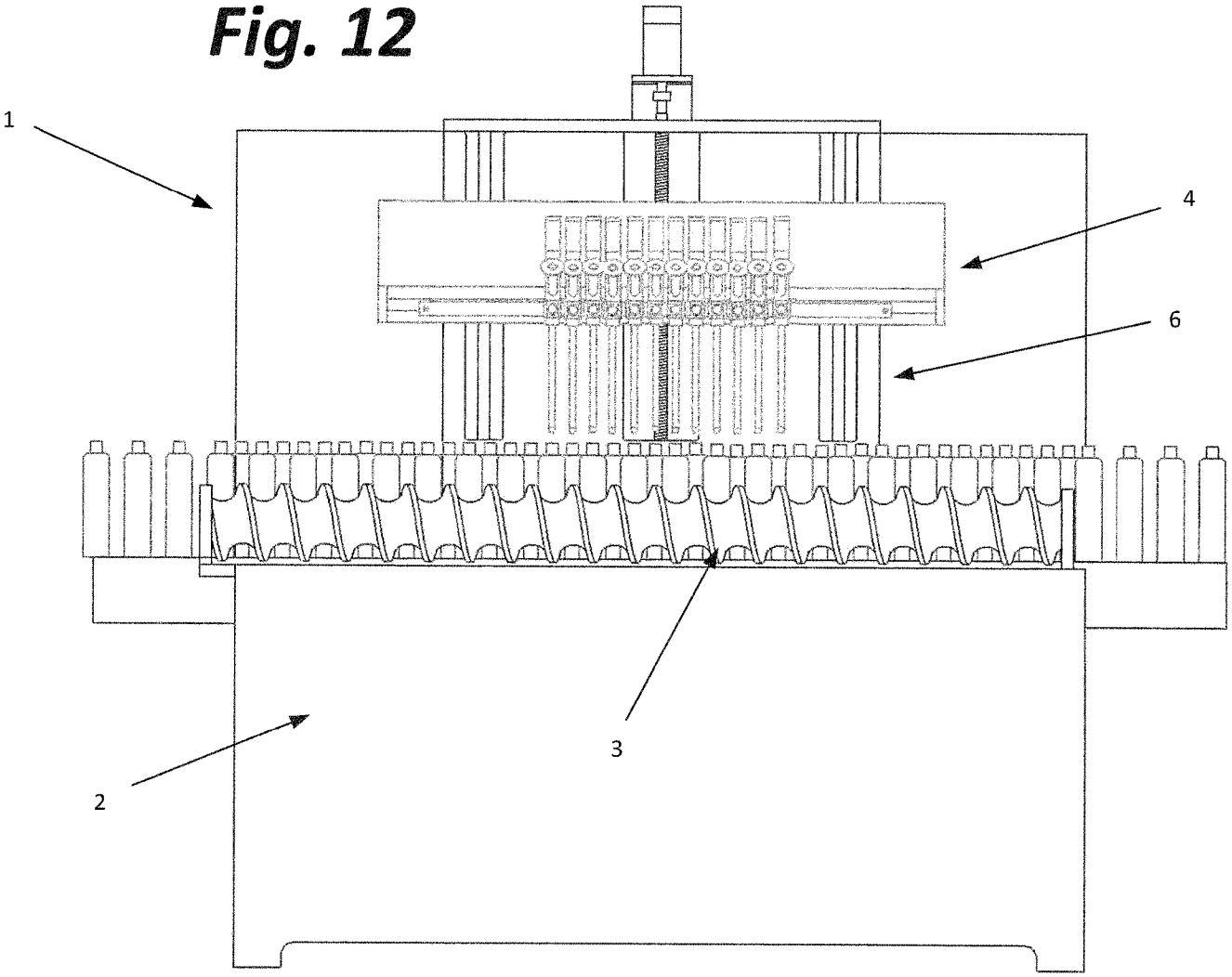
FIG. 12 is a front view of the carriage assembly of FIG. 7 with the vertical carriage in the raised position and the horizontal carriage about between the second termination point and the first termination point.

Once the nozzles are decoupled from the containers, the controller 100 sends a signal to motor 68 causing the horizontal carriage to move back through the position shown in FIG. 12, toward the first termination point and "start" position shown in FIG. 7. This occurs in time for the lead containers (75 and 81) to be above the next containers 30 (in the two rows 32 and 34) that need to be filled. The process is then repeated until the necessary number of containers 30 is filled.

The synchronization achieved by the filler 1 permits containers to be filled at a steady and remarkable rate. This is because the controller 100 never turns the conveyor off until instructed to do so and controls the conveyor to move the containers at the predetermined desired speed. Likewise, the controller 100 synchronizes the operation of the carriage assembly to ensure the nozzles are constantly moving either up and down or side-to-side without any dwell period. The controller further operates to ensure that material is only pumped through the nozzles when the nozzles are engaged with the containers.

Figure 14:
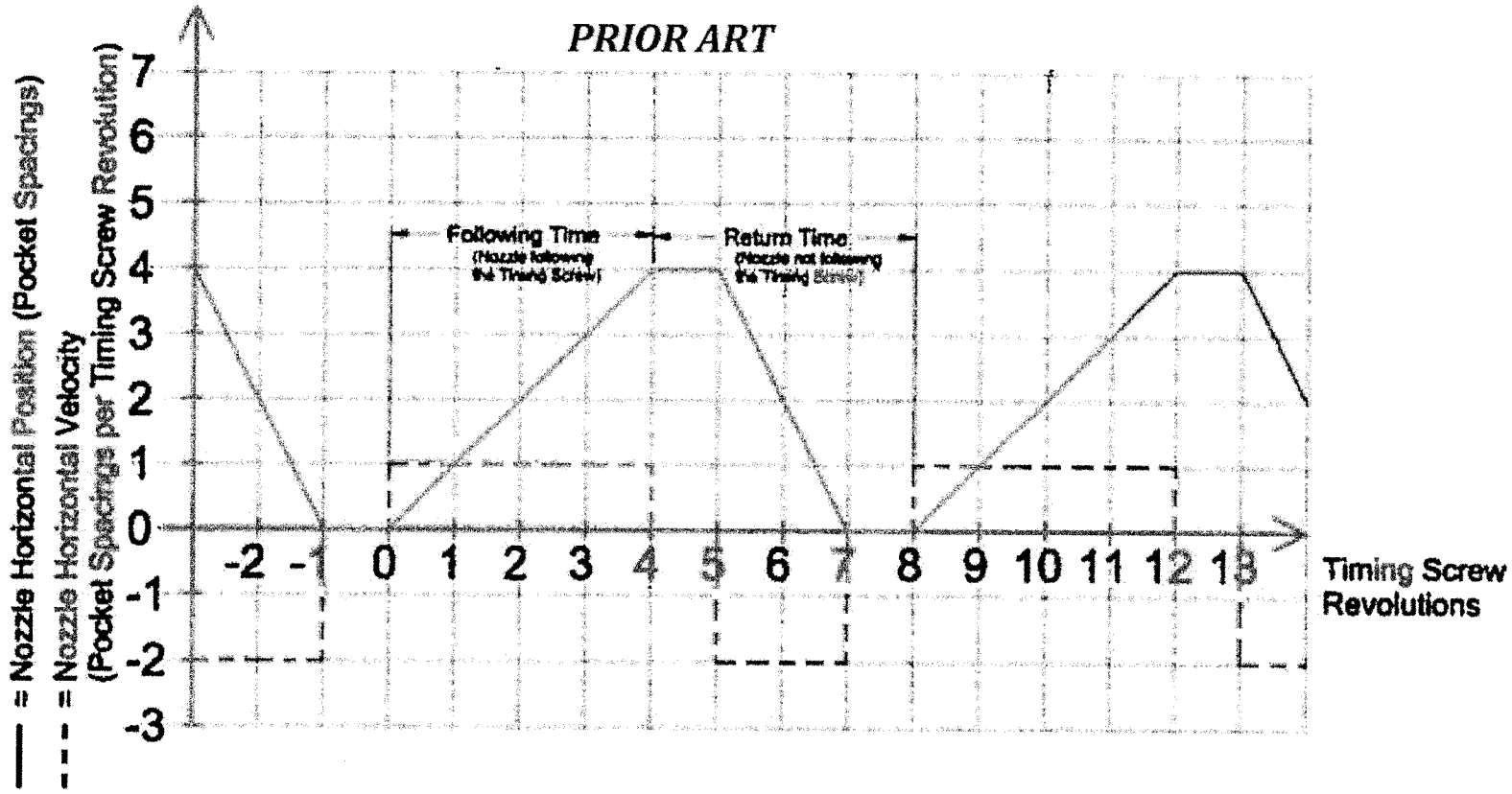
FIG. 14 is a graph illustrating the motion of the conveyor and nozzles of a prior art filling machine.
Figure 15:
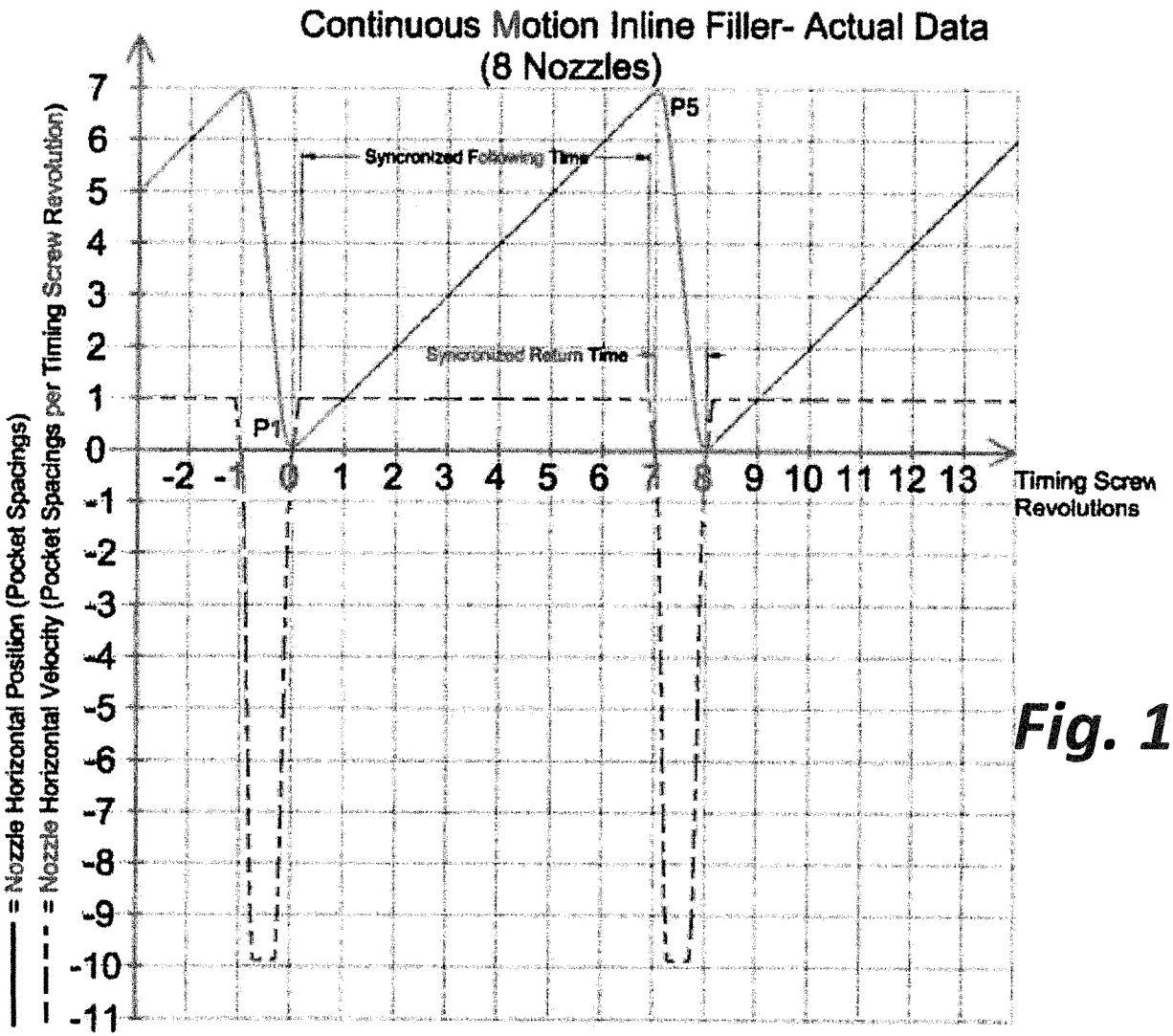
FIG. 15 is a graph illustrating the motion of the conveyor and nozzles of a filler made in accordance with the present invention.

FIGS. 14 and 15 provide a comparison of the relative motion of the conveyor and nozzles of a prior art linear filling machine (FIG. 14) to a filling machine embodying the claimed invention (FIG. 15). In the prior art, the return time (i.e., the time for the nozzles to return from the second termination point to the first termination (or start) point) is much longer, four revolutions of the screw of the conveyor rather than one revolution. In the prior art, there is also a dwell period of about one full revolution while there is no dwell period in the embodiment incorporation in the invention. When the present invention is employed, this lengthy dwell period is eliminated and the controller ensures that, during operation, the horizontal carriage moves continuously and instantaneously (i.e., without any dwell period at either termination point) back and forth between said first termination point and said second termination point. Also, the speed at which the nozzles move up and down in the prior art is much slower than in the preferred embodiment.

The above-described apparatus is highly adaptable. The speed of the conveyor 3 and carriage assembly 4 may be altered to conform with the speed of equipment supplying bottles to the filler 1 or the equipment at the discharge end used to carry the filled containers to a capping machine or storage area. Likewise, a smaller or larger number of nozzles may be included in each row of nozzles. The controller is able to adapt the operation of the carriage assembly and pumping system comprising the nozzles, the valve and the pump/motor assembly accordingly. Also, a conveyor and a carriage assembly providing additional rows of bottles and nozzles may be provided in accordance with the invention to yield even greater output of filled containers. The containers are not limited to any particular size, shape or capacity. The conveyor 3, carriage assembly 4 and controller 100 are easily adjusted to conform to the selected containers. This typically means using a conveyor 3 adapted to the particular shape of the container, adjusting the position of the nozzles on the horizontal carriage and adjusting a limited number of parameters on the controller. Further, the screw type conveyor(s) show were selected because they are able to precisely index the containers as they pass through the filling station to ensure proper spacing between the openings of the containers. The screw conveyors of the conveyor assembly may be replaces with some other type of conveyor that is also able to precisely index the containers as they pass through the filling station to ensure proper spacing between the openings of the containers.

Further, the controller 100 has the processing power necessary to control multiple conveyor assemblies and multiple carriage assemblies. Thus, the filling machine may be provided with multiple conveyor and carriage assemblies without deviating from the invention and to further increase the throughput of filled containers per minute. Likewise, while FIGS. 7-12 show two rows of nozzles attached to a single horizontal carriage of a single carriage assembly, the carriage assembly may be provided with multiple horizontal carriages 66, each carrying a row of nozzles. Multiple separate carriage assemblies may also be employed. The drawings also show the vertical carriage 52 attached to the carriage assembly support 28 of the base 2, the horizontal carriage 66 attached to the vertical carriage 52, and the nozzles 70-81 attached to the horizontal carriage 66. Without deviating from the invention, these components may be alternatively coupled together so that the horizontal carriage 66 is attached to the carriage assembly support 28 of the base 2, the vertical carriage 52 is attached to the horizontal carriage 66 and the nozzles 70-81 are attached to the vertical carriage 52.

As such, the present invention is versatile, efficient and requires only limited space.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. For filling with a material a plurality of containers, each having a top opening with a center point, a filling apparatus comprising:

a. a base;

b. a conveyor assembly comprising at least one conveyor coupled to the base and adapted to carry said plurality of containers in at least one row of containers in a first direction at a predetermined constant speed with the center points of the openings of each adjacent pair of said containers of each row of containers being a predetermined distance apart;

c. a carriage assembly coupled to the frame and disposed above the conveyor, said carriage assembly having at least one vertical carriage, at least one horizontal carriage, and a plurality of nozzles each having an ejection port, said at least one horizontal carriage adapted to reciprocate side to side between a first termination point and a second termination point, said at least one vertical carriage coupled to said at least one horizontal carriage and adapted to move up and down between a raised position and a lowered position, said nozzles adapted to move up and down with the at least one vertical carriage and side to side with the at least one horizontal carriage, said plurality of nozzles arranged in at least one row of nozzles with each row of nozzles comprising a leading nozzle and the ejection ports of each adjacent pair of nozzles in each row of nozzles being said predetermined distance apart;

d. a microcontroller adapted to control and synchronize the speed of the conveyor, movement of said at least one horizontal carriage so that during operation the horizontal carriage moves continuously and instantaneously between said first termination point and said second termination point, and movement of said at least one vertical carriage between said raised position and said lowered position;

wherein, as said at least one conveyor carries said plurality of containers in said first direction, said controller is adapted to repeatedly cycle the carriage assembly to (i) cause said at least one horizontal carriage, upon reaching the first termination point, to immediately move toward the second termination point with each of said nozzles aligned with the top opening a container to be filled, (ii) cause said at least one vertical carriage, while the at least one vertical horizontal carriage is moving from the first termination point to the second termination point, to move from the raised position to the lowered position so that each of the nozzles engages a container to be filled with the material and, after the containers engaged by the nozzles are filled with the material, to return to the raised position no later than the point in time at which the at least one horizontal carriage reaches the second termination point, (iii) cause the at least one horizontal carriage to move toward the first termination point immediately upon the at least one horizontal carriage reaching the second termination point, and (iv) cause the leading nozzle of each row of nozzles to be positioned above the first yet to be filled container in the row of containers upon the at least one horizontal carriage reaching the first termination point and beginning to again move back toward the second termination point.

2. The filling apparatus of claim 1 wherein said at least one conveyor comprises a screw having a shaft extending along a longitudinal axis surrounded by flight, wherein the flight indexes the spacing between the center points of the top openings of the containers and the screw is adapted to rotate to move the containers in the first direction.

3. The filling apparatus of claim 1 wherein the predetermined constant speed is variable.

4. The filling apparatus of claim 1 further comprising at least one pump adapted to be controlled by the controller and pump material through the nozzles only when at least one of the nozzles is in filling engagement with a container.

5. The filling apparatus of claim 1 further comprising at least one valve coupled to a nozzle and having an open position which allows material to flow through the nozzle and a closed position restricting the flow of material through the nozzle, wherein the valve is in the open position when the nozzle is in filling engagement with the top opening of a container and otherwise the nozzle is closed.

6. The filling apparatus of claim 5 wherein actuation of the valve of each nozzle between the open position and the closed position is controlled by the controller.

7. The filling apparatus of claim 1 wherein the at least one conveyor is adapted to carry the containers in two rows in the first direction and the nozzles are arranged in two rows.

8. The filling apparatus of claim 7 wherein said at least one conveyor comprises a pair of screws and a guide plate positioned between the screws, wherein each screw has a shaft defining a longitudinal axis of rotation and a flight surrounding the shaft, wherein the longitudinal axes of said screws are parallel to each other, and wherein each of said screws is adapted to rotate to move the containers of each row of containers in the first direction.

9. The filling apparatus of claim 8 wherein the flight of each screw comprises container dividing members.

10. The filling apparatus of claim 1 wherein servomotors are used to move the screws, said servomotors adapted to send signals to the controller that are processed by the controller to synchronize the position and speed of the screws, and further adapted to receive signals from the controller to adjust the position and speed of the screws so the screws turn in synchronization with each other.

11. For filling with a material a plurality of containers, each having a top opening with a center point, a filling apparatus comprising:

a. a base;

b. a conveyor assembly comprising at least one conveyor coupled to the base and adapted to carry said plurality of containers in at least two rows of containers in a first direction at a predetermined constant speed with the center points of the openings of each adjacent pair of said containers of each row of containers being a predetermined distance apart;

c. a carriage assembly coupled to the frame and disposed above the conveyor, said carriage assembly having a vertical carriage, a horizontal carriage, and a plurality of nozzles each having an ejection port, said horizontal carriage adapted to reciprocate side to side between a first termination point and a second termination point, said vertical carriage member coupled to said horizontal carriage and adapted to move up and down between a raised position and a lowered position, said nozzles adapted to move up and down with the vertical carriage and sided to side with the horizontal carriage, said plurality of nozzles arranges in at least two rows of nozzles with each row of nozzles comprising a leading nozzle and the ejection ports of each adjacent pair of nozzles in each row of nozzles being said predetermined distance apart;

d. a microcontroller adapted to control and synchronize the speed of the conveyor, movement of said horizontal carriage so that during operation the horizontal carriage moves continuously and instantaneously between said first termination point and said second termination point, and movement of said vertical carriage between said raised position and said lowered position;

wherein, as said conveyor carries said plurality of containers in said first direction, said controller repeatedly cycles the carriage assembly to (i) cause said horizontal carriage, upon reaching the first termination point, to immediately move toward the second termination point with each of said nozzles aligned with the top opening a container to be filled, (ii) cause said vertical carriage, while the horizontal carriage is moving from the first termination point to the second termination point, to move from the raised position to the lowered position so that each of the nozzles engages a container to be filled with the material and, after the containers engaged by the nozzles are filled with the material, to return to the raised position no later than the point in time at which horizontal carriage reaches the second termination point, (iii) cause the horizontal carriage to move toward the first termination point immediately upon the horizontal carriage reaching the second termination point, and (iv) cause the leading nozzle of each row of nozzles to be positioned above the first yet to be filled container in the row of containers upon the horizontal carriage assembly reaching the first termination point and beginning to again move back toward the second termination point.

12. The filling apparatus of claim 11 wherein said at least one conveyor comprises at least two screws each having a shaft extending along a longitudinal axis surrounded by flight, wherein the flight of one of the screws indexes the spacing between the center points of the top openings of the containers of a first row of containers and the flight of another of the screws indexes the spacing between the center points of the top openings of the containers of a second row of containers, and said screws are adapted to rotate to move the containers of each row of containers in the first direction.

13. The filling apparatus of claim 11 wherein the predetermined constant speed is variable.

14. The filling apparatus of claim 11 further comprising at least one pump adapted to be controlled by the controller and pump material through the nozzles only when each of the nozzles is in filling engagement with containers.

15. The filling apparatus of claim 11 further comprising at least one valve coupled to a nozzle and having an open position which allows material to flow through the nozzle and a closed position restricting the flow of material through the nozzle, wherein the valve is in the open position when the nozzle is in filling engagement with the top opening of a container and otherwise the nozzle is closed.

16. The filling apparatus of claim 15 wherein actuation of the valve of each nozzle between the open position and the closed position is controlled by the controller.

17. The filling apparatus of claim 11 wherein said at least one conveyor comprises a pair of screws and a guide plate positioned between the screws, wherein each screw has a shaft defining a longitudinal axis of rotation and a fight surrounding the shaft, wherein the longitudinal axes of said screws are parallel to each other, and wherein said screws are adapted to rotate to move the containers of each row of containers in the first direction.

18. The filling apparatus of claim 17 wherein the flight of each screw comprises container dividing members.

19. The filling apparatus of claim 11 wherein the vertical carriage is attached to the base via at least one track along which the vertical carriage moves up and down, the horizontal carriage is attached to the vertical carriage via at least one track along which the vertical carriage moves side to side, and said nozzles are attached to said horizontal carriage.

20. The filling apparatus of claim 11 wherein servomotors are used to move the horizontal carriage and the vertical carriage, said servomotors adapted to send signals to the controller that are processed by the controller to synchronize the position and speed of the horizontal carriage and vertical carriage, and further adapted to receive signals from the controller to adjust the position and speed of the horizontal carriage and vertical carriage.

* * * * *